United States Patent [19]

Maxwell et al.

[11] Patent Number: 4,864,090

[45] Date of Patent: Sep. 5, 1989

[54] BAG UTILIZING A MICROWAVE SUSCEPTOR PAD AND NON-HEATED FLAP

[75] Inventors: Holly Maxwell, Forest Lake; Warren D. Petersen, Corcoran, both of Minn.

[73] Assignee: General Mills, Inc., Minneapolis, Minn.

[21] Appl. No.: 261,192

[22] Filed: Oct. 24, 1988

[51] Int. Cl.[4] ..... H05B 6/80

[52] U.S. Cl. ..... 219/10.55 E; 219/10.55 F; 426/107; 426/243; 99/DIG. 14

[58] Field of Search ..... 219/10.55 E, 10.55 F, 219/10.55 M; 426/107, 109, 110, 111, 112, 113, 115, 241, 243, 234; 383/104, 124, 126; 99/DIG. 14, 451

[56] References Cited

U.S. PATENT DOCUMENTS

| | | | |
|---|---|---|---|
| 3,484,037 | 12/1969 | Kugler | 383/104 X |
| 3,799,914 | 3/1974 | Schmit et al. | 426/115 X |
| 4,082,216 | 4/1978 | Clarke | 383/104 X |
| 4,286,136 | 8/1981 | Mason, Jr. | 219/10.55 E |
| 4,367,842 | 1/1983 | Rausing | 426/110 X |
| 4,590,349 | 5/1986 | Brown et al. | 219/10.55 E |
| 4,678,882 | 7/1987 | Bohrer et al. | 219/10.55 E |
| 4,691,374 | 9/1987 | Watkins et al. | 383/104 |

*Primary Examiner*—Philip H. Leung

*Attorney, Agent, or Firm*—L. MeRoy Lillehaugen; John A. O'Toole; Stuart R. Peterson

[57] ABSTRACT

Several package embodiments are illustrated. In two embodiments, a panel constitutes an extension of one wall of a flexible bag having therein a susceptor pad. Only a portion of the panel is adhesively secured to the end wall, there being a second portion constituting a flap that extends freely from the bag so that the flap remains quite cool when the package is heated in a microwave oven, even though the bag itself becomes quite hot. The third embodiment involves an individual panel having one portion thereof adhesively secured to an end wall of the bag and a second portion constituting a flap that extends upwardly from the end wall so that the flap remains relatively cool and can be grasped with a person's fingers to effect safe handling of the bag after being heated in the microwave oven.

11 Claims, 5 Drawing Sheets

FIG. 2
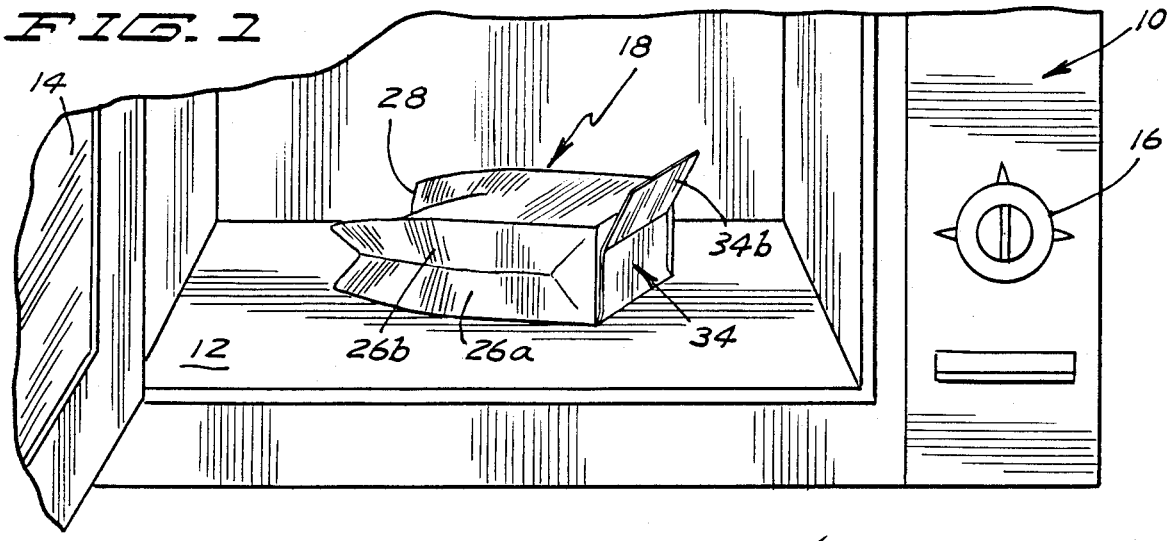
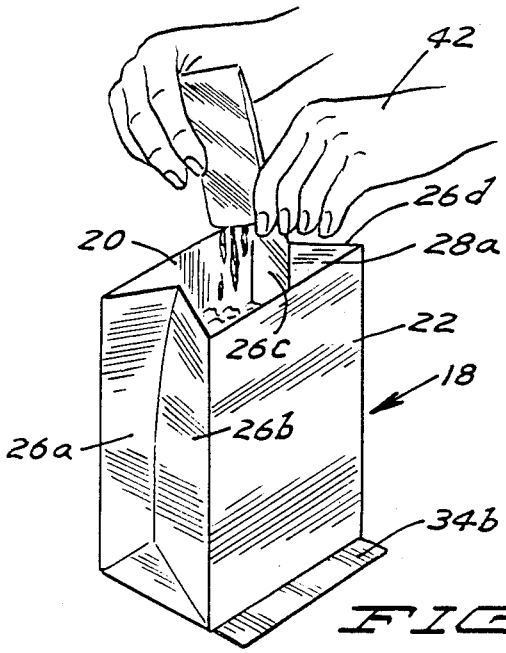
FIG. 4
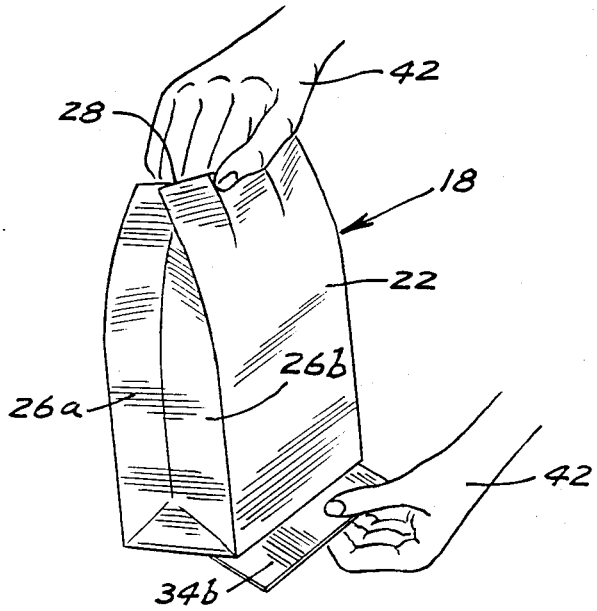
FIG. 6
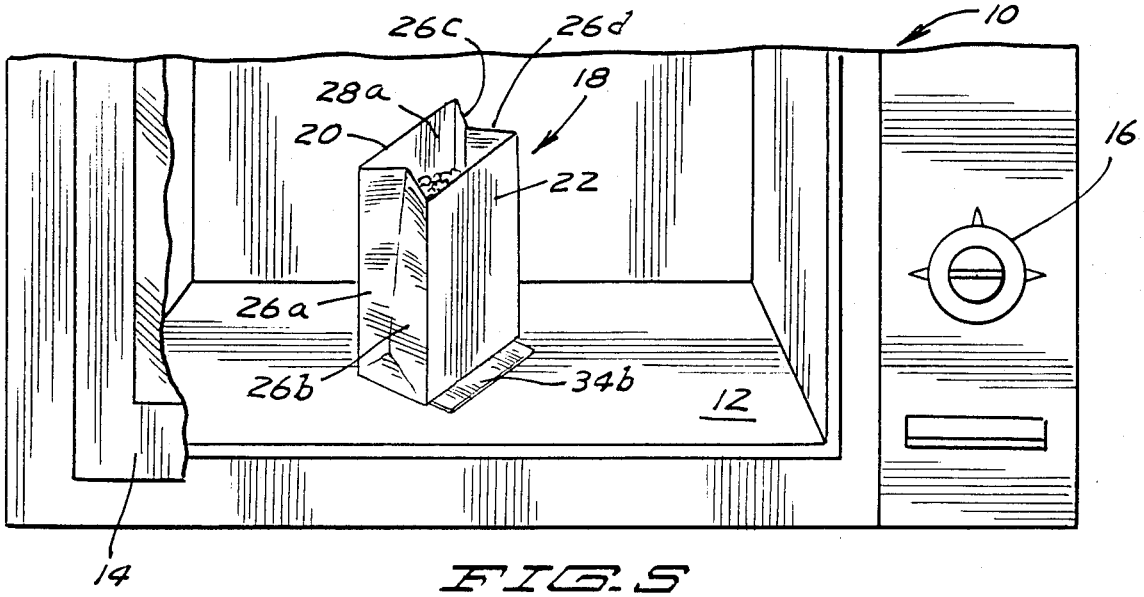
FIG. 5

BAG UTILIZING A MICROWAVE SUSCEPTOR PAD AND NON-HEATED FLAP

BACKGROUND OF THE INVENTION

1. Field of the Invention

This invention relates generally to packages for use in microwave ovens, and pertains more particularly to a flexible bag having a non-heated flap spaced from the susceptor pad that converts microwave energy to thermal energy.

2. Description of the Prior Art

Packages especially suited for popping corn in microwave ovens have met with tremendous success. Essential to obtaining effective popping of the corn kernels is a susceptor pad such as that described in Brastad U.S. Pat. No. 4,267,420 and Brastad et al U.S. Pat. No. 4,230,924. There are a number of more recent patents in which the popping of corn is accomplished with the aid of a susceptor pad. Basically, the susceptor pad material described in said numerically-identified patents (and also the more recently issued ones which need not be specifically identified) involves a metallized film that converts some of the microwave energy into thermal energy. Inasmuch as elevated temperatures are necessary to effectively pop corn, the entire package becomes extremely hot and difficult to handle by the time the popping cycle has been completed and the package is ready to be removed from the microwave oven. The problem is compounded when a flavoring agent is to be added. A partial and somewhat impractical solution to the problem has been that the individual consumer resorts to a hot pad or towel to remove the package and during the subsequent handling thereof. However, this is bothersome and frequently the consumer will neglect to use such an item with the consequence that discomfort, and in some cases burning, is experienced when the heated package is directly touched with one's fingers.

SUMMARY OF THE INVENTION

Accordingly, an important object of the present invention is to provide a means enabling the consumer to handle readily a hot package, such as that in which popcorn has been popped, without having to resort to any supplemental aid or auxiliary means. More specifically, an aim of the invention is to provide a non-heated flap located in a spaced relation with the package's susceptor pad. In that the flap remains comparatively cool, considerably cooler than the remainder of the package, the consumer is able to grasp the flap without experiencing discomfort.

Another object is to provide a package of the foregoing character that can be fabricated with only a slight increase in production costs, yet the benefits are greatly increased in that the chance of burning one's fingers is for all intents and purposes completely obviated when removing the heated package from a microwave oven and during the subsequent handling thereof, such as when adding a flavoring agent.

Yet another object of the invention is to provide a package, especially one suited for popping corn, that can be shipped in a flat or collapsed condition with other such packages to the location where the packages are filled with the product to be heated, thereby avoiding any increase in shipping costs over what it would cost to ship conventional unfilled packages. Also, the invention permits the packages after filling to be compactly shipped in that our invention does not add to the space that is needed.

Still another object is to provide a package involving a flexible bag that will not only prevent the consumer from burning his or her fingers but in which no sacrifice in heating efficiency is experienced. Stated somewhat differently, the package constituting a flexible bag functions in its normal manner as far as its heating effectiveness is concerned, yet the consumer can safely handle the package after the package and its contents have been heated to the required temperature, particularly during the shaking period after a flavoring agent has been added.

A further feature of our invention resides in providing a package with a flap, which remains unheated, that makes it obvious to the user that the flap should be grasped when handling the bag, thereby avoiding the need for special instructions which the user might very well neglect to read before placing the package in a microwave oven.

Still another object of the invention is to provide a package for use in microwave ovens in which it is readily apparent which side of the package is to face upwardly and which side is to face downwardly. In this regard, it should be recognized that the susceptor pad must be lowermost when heating a package of this type, and the presence and location of the non-heated flap visually conveys this information to the consumer.

Briefly, our invention contemplates a package in the form of a flexible bag utilizing a susceptor pad therein for converting a percentage of the microwave energy to thermal energy so that the contents of the package will be effectively heated. Basically, the bag is of conventional construction, but the fabrication thereof is modified so that a readily grasped flap is available when handling the bag. In this way, the consumer can avoid touching any surface portion of the bag that is of an elevated temperature when removing the bag from the microwave oven after the bag and its contents have been sufficiently heated, the removal being easily achieved without danger of the consumer burning his or her fingers. Even more importantly in a sense is the capability of being able to manipulate the package during the adding of a flavoring agent, the reinsertion of the package into the microwave oven after a flavoring agent has been added, and during the subsequent shaking of the package to mix and thoroughly disperse the additive with the popped corn.

BRIEF DESCRIPTION OF THE DRAWINGS

FIG. 1 is a perspective view of a microwave oven with most of its closed door removed so as to expose to view a package fabricated in accordance with our invention, the popping cycle having just been completed and the package ready to be removed;

FIG. 4 is a perspective view of the bag in an upright position, the view showing a flavoring agent being added;

FIG. 5 is a perspective view of the bag in the same upright condition in which it appears in FIG. 4 but after it has been reinserted in the microwave oven;

FIG. 6 is a perspective view of the bag after its second removal from the microwave oven, the view depicting the bag being shaken so as to disperse the flavoring agent throughout the popped corn;

DESCRIPTION OF THE PREFERRED EMBODIMENT

Figure 2:
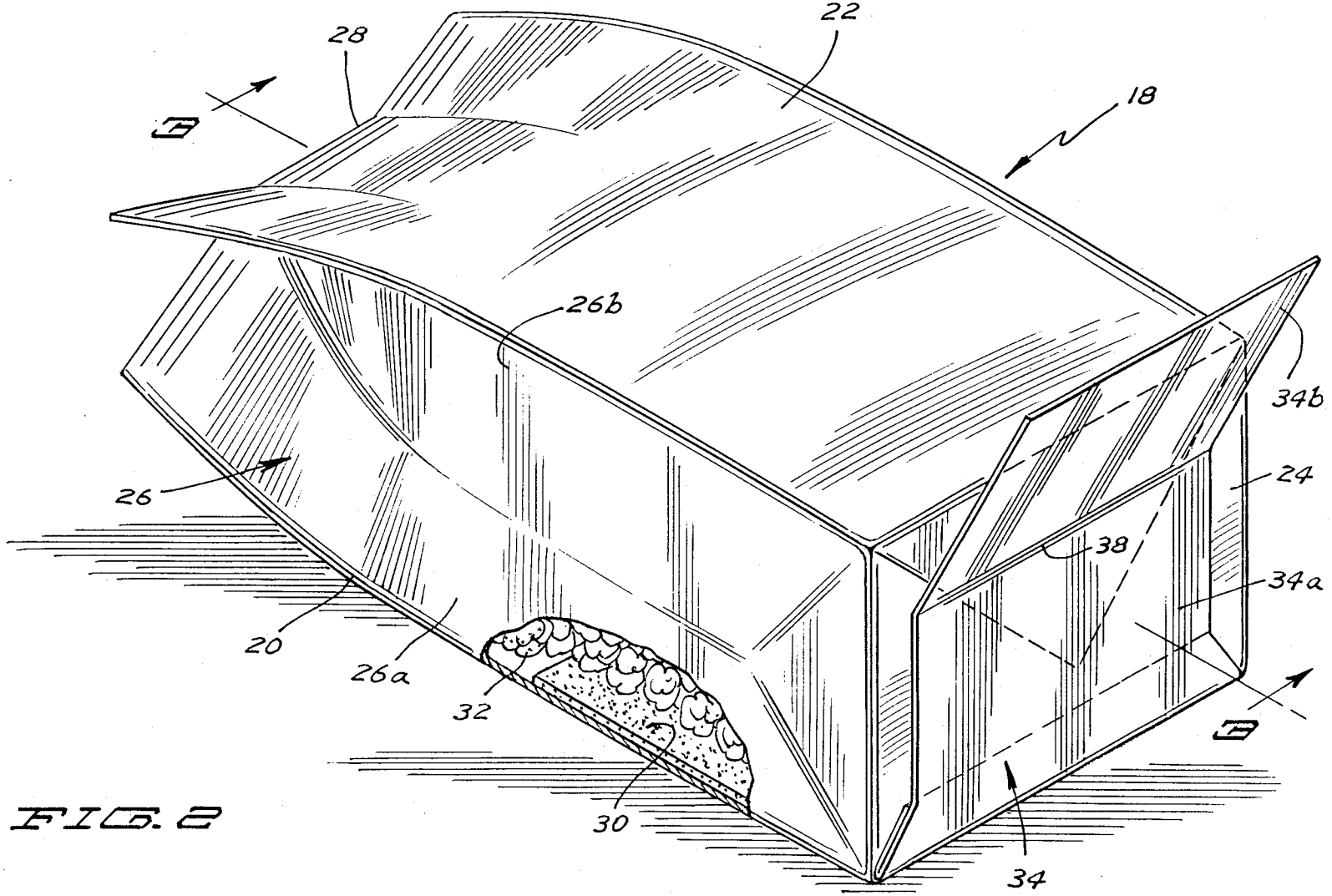
FIG. 2 is an enlarged perspective view of the square bottom bag of FIG. 1, the bag embodying one form of our invention.

Although conventional, attention is first directed to a microwave oven 10 appearing in FIGS. 1 and 5 having a floor or bottom 12, a hinged door 14 and appropriate controls at 16. The door 14, while only frequently shown, is in its closed position in that the package there illustrated which exemplifies one embodiment of our invention is in the form of a flexible bag 18 having what would normally be called a square bottom. However, it will facilitate the ensuing description to consider the bag in the horizontal position shown in FIGS. 1, 2 and 3. Therefore, the bag 18 includes a bottom wall 20, a top wall 22, an end wall 24, side walls 26 and a closed end 28.

The cross sectional makeup of the end wall 24 includes a number of folds that are not important to an understanding of our invention, so will not be specifically described, although the end wall 24 should be constructed so as to seal adequately the vapor created within the bag 18 during the heating thereof in the microwave oven 10. In the practicing of our invention, however, it is important that the end wall 24 have a flat rectangular or square configuration. Such bags are commonly referred to as square bottom bags in the trade. Likewise, the construction of the side walls 26 is not critical to a practicing of our invention. All that need be said is that the side walls 26 include gussets or pleats **26*a*, 26*b*, 26*c* and 26*d* that enable the side walls 26 to expand during a heating cycle. Still further, the left end 28 is closed by heat sealing the marginal ends of the pleats 26*a*, 26*b*, 26*c* and 26*d*** together.

Figure 3:
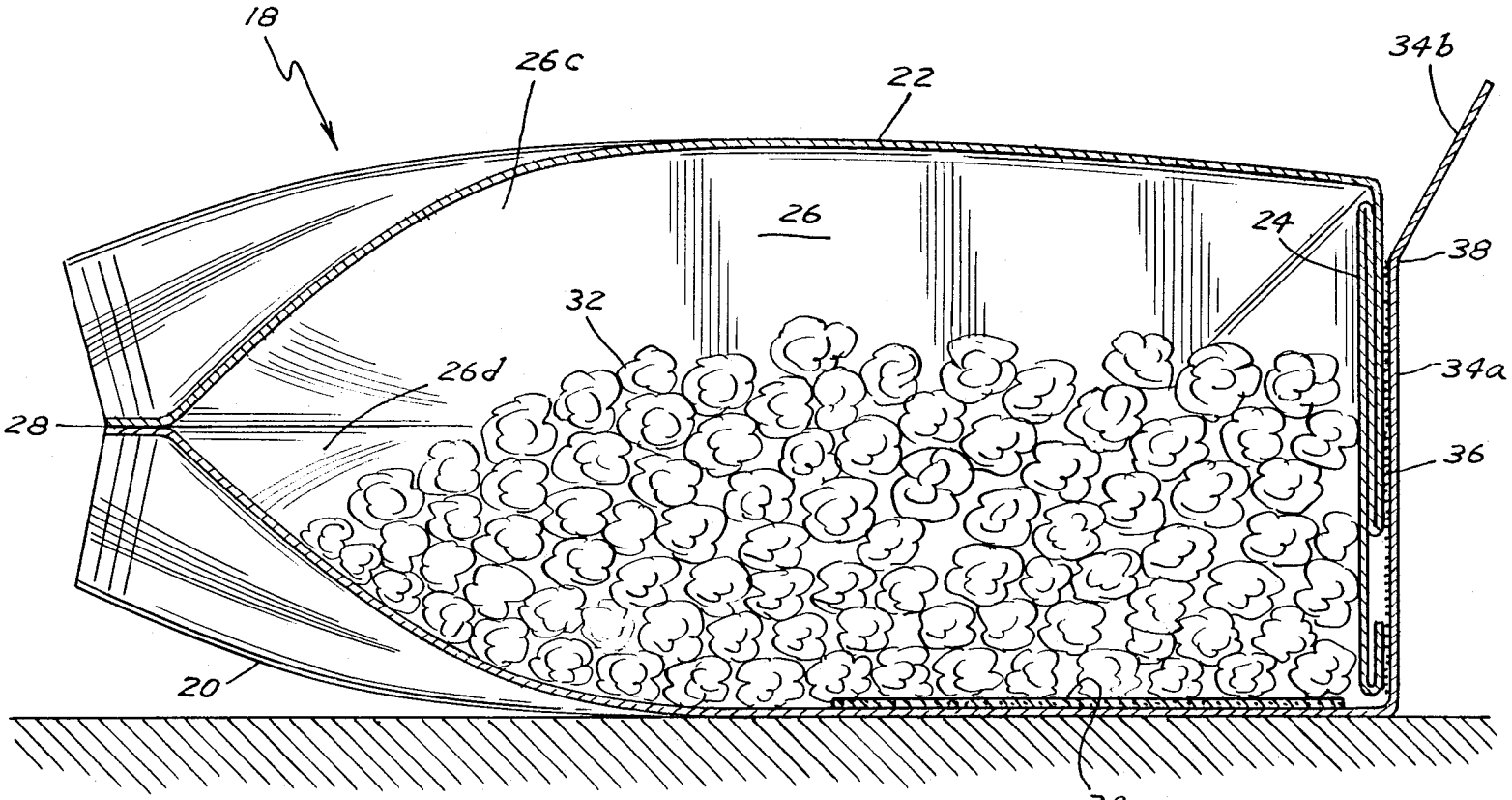
FIG. 3 is a longitudinal sectional view taken in the direction of line 3—3 of FIG. 2.

Attention is now directed to a susceptor pad 30 that overlays a portion of the bottom wall 20. FIG. 3 is intentionally simplified so as to show the pad 30 clearly without resort to the laminations normally made use of in a bag of this type. It might be explained, though, that the bag 18 is fabricated from tubular bag stock composed of kraft paper lined with glassene paper or the equivalent thereof. As is obvious from FIG. 3, the laminated construction of the walls constituting the bag 18 is not shown. Actually, the layer of glassene paper that has been referred to could extend over the upper surface of the susceptor pad 30.

For the sake of completeness, it will be assumed that the contents of the bag 18 are popcorn kernels and the popped kernels have been generally indicated by the reference numeral 32 in FIG. 3, having been popped when in the microwave oven 10.

Playing an extremely important role in safeguarding against burns is a panel 34 that in the illustrated embodiment of FIGS. 1, 2 and 3 constitutes an integral extension of the bottom wall 20. More specifically, the panel 34 includes a first portion **34*a* and a second portion 34*b*. The portion 34*a* is secured to the end wall 24 by means of an adhesive labeled 36. However, it is important to recognize that the adhesive 36 only extends over the surface of the portion 34*a* and does not extend over any part of the portion 34*b*. Thus, the portion 34*b* constitutes a free flap extending upwardly beyond the top wall 22. In this regard, it can be stated that the portion 34*b* is hinged at a location denoted by the reference numeral 38**.

Consequently, with the foregoing description in mind, it should now be apparent that the free portion **34*b* that functions as a flap presents a considerable surface area divorced and separated from the bag 18, more specifically being divorced from any surface portion of the end wall 24 and at the same time spaced from the susceptor pad 30. Hence, it is difficult for any heat generated within the confines of the bag 18 to reach the portion 34*b*. Thus, the portion 34*b*, which once again constitutes a free flap, remains unheated and can be readily grasped by the consumer, even though the remainder of the bag 18** is at an appreciably elevated temperature, a temperature entirely too hot for a person to touch without being burned.

Although the flap portion **34*a* facilitates the removal of the bag 18 from the microwave oven 10 at the conclusion of the popping cycle, the flap portion 34*b* is in a sense of even greater benefit when adding a flavoring agent, such as a caramel sauce. Therefore, reference should now be made to FIG. 4 where the bag 18 has been shown resting on its end wall 24 with its end 28 now open and denoted by the reference numeral 28*a***.

The closed end 28 is readily opened by grasping the side walls 26 in this region while the bag 18 is in the upright position in which it appears in FIG. 4. It is not believed necessary to show this step but it should be appreciated that the flap portion **34*b* makes it quite easy for the user to place the bag 18 in its upright position shown in FIG. 4**.

It will be assumed that a flavoring agent is to be added and that it constitutes a caramel sauce. Therefore, a small plastic pouch 40 has been pictured, being held by a person's hands 42 while the pouch's contents are being poured into the now open bag 18. After the pouring step, the bag 18 with the caramel sauce now contained therein is reinserted in the microwave oven 10, as illustrated in FIG. 5. The oven 10 is again turned on through the agency of its controls 16, and remains on only for a relatively brief period—only long enough to lower the viscosity of the sauce sufficiently so that it can be dispersed uniformly over the popped corn 32. It should be recognized, though, that the bag 18 may very well become hotter than when removed after the popping cycle.

It is at this time that the bag 18 is again removed from the microwave oven 10, being now ready for the shaking step of FIG. 6. It will be noted that one hand 42 is in FIG. 6 grasping the flap portion **34*b* and the other hand 42 the end 28*a* that is being held sufficiently closed so as to prevent escape of any of the popped corn 32 or the flavoring that has been added from the pouch 40. All that need be appreciated is that the shaking in FIG. 6 can be quite vigorous in that the flap portion 34*b* can be firmly held without the consumer being burned. The open end 28*a*, now closed by the fingers of one hand 42, being spaced a considerable distance from the susceptor pad 30 has remained relatively cool. Hence, both ends of the bag 18 may be firmly held by the user's hands 42 during the shaking period portrayed in FIG. 6, and of course without the danger of being burned in that the very hot surfaces of the bag 18** are not being touched.

It is not believed necessary to show the bag 18 in its collapsed condition. In initially shipping the bag 18, along with numerous other bags, the top wall 22 would confont the bottom wall 20 and the end wall 24 would be folded into substantially the same plane as the walls 20 and 22. It is not believed necessary to illustrate the bag 18 in its completely folded condition. However, a fold line would be appropriately located so that the bag can be flattened. It is the popping of the popcorn 32 that expands the bag 18 into the condition pictured in FIGS. 1, 2 and 3.

Figure 7:
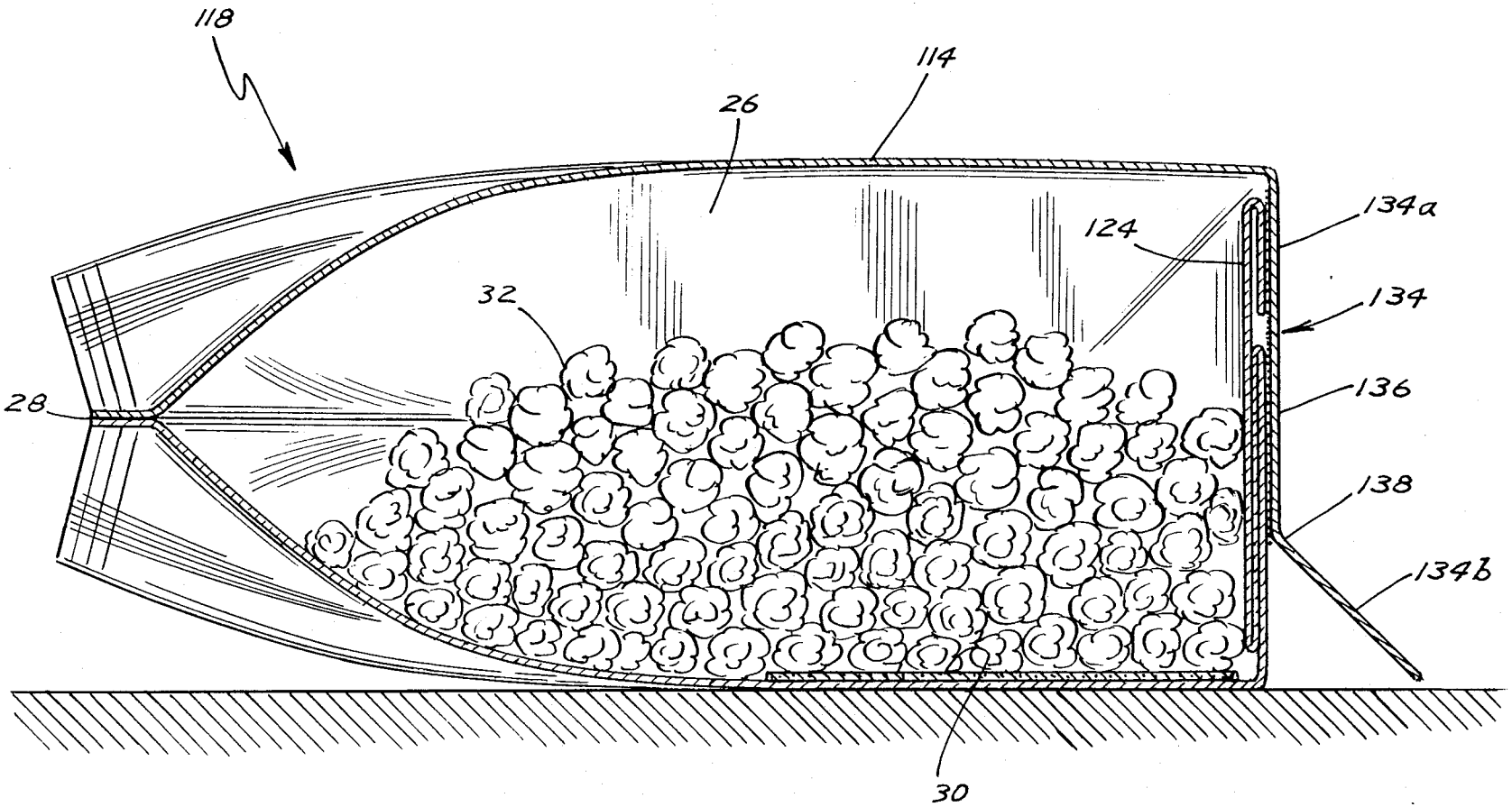
FIG. 7 is a sectional view of a somewhat modified version of our invention, the flap angling downwardly rather than upwardly.
Figure 8:
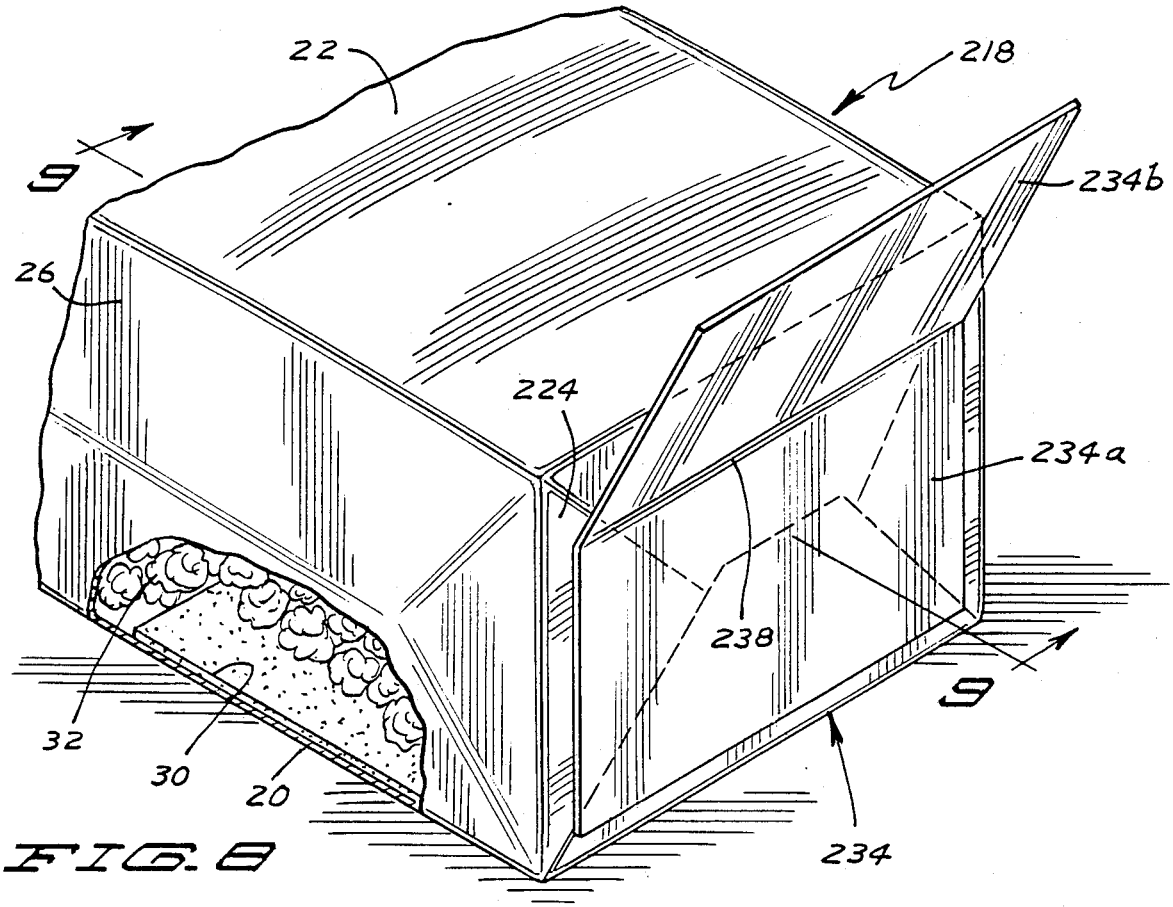
FIG. 8 is a fragmentary perspective view of a bag depicting a different embodiment that our invention may assume.
Figure 9:
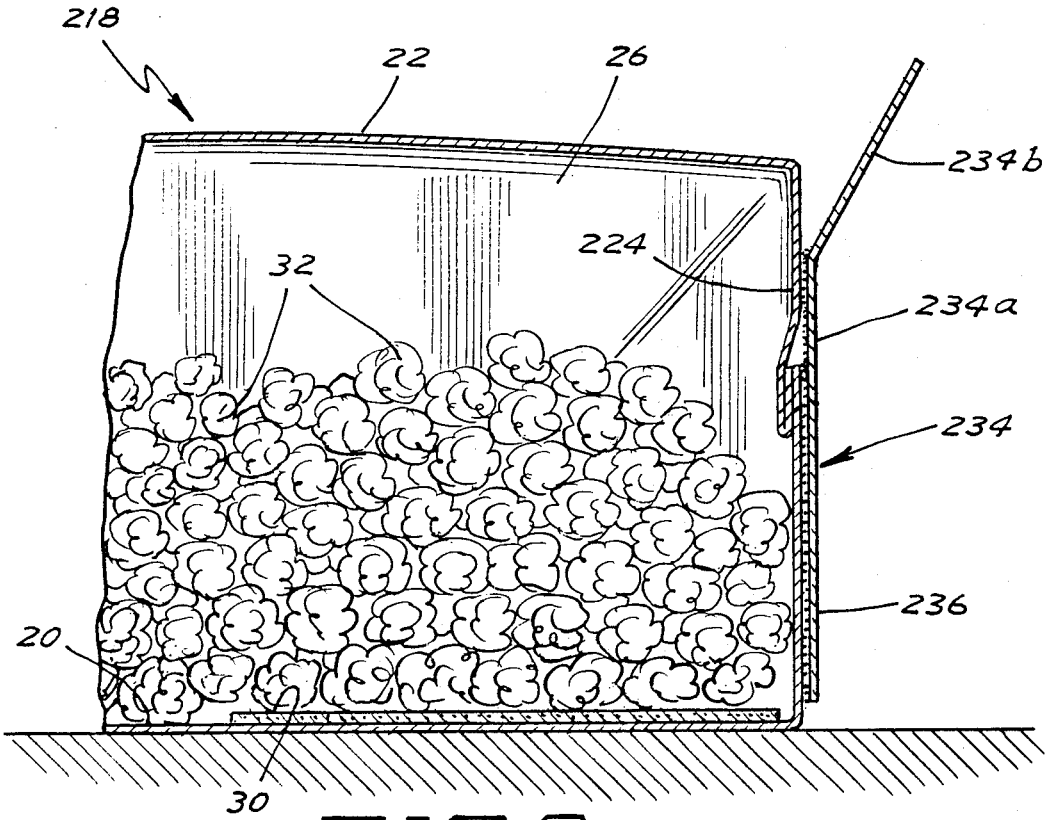
FIG. 9 is a sectional view taken in the direction of line 4—4 of FIG. 3.

Reference will now be made to FIG. 7 where the bag 118 includes a top wall 114 having a panel 134 constituting an integral extension of the top wall 114. In this instance, the panel 134 includes a first portion **134*a* and a second portion 134*b*. The portion 134*a* is secured to the end wall 124 by means of an adhesive 136. In this instance, the portion 134*b* constitutes a free flap extending downwardly from its hinged location 138. Other than the slightly different arrangement described above. The construction of the bag 118 is the same as that of the bag 18 so for the most part the same reference numerals have been employed The embodiment of FIGS. 8 and 9 is quite similar to that of the embodiment of FIGS. 1–6. Therefore, the same reference numerals have been applied to FIGS. 8 and 9 where there is identity, or virtual identity. At any rate, the package embodiment of FIGS. 8 and 9 is in the form of a bag indicated by the reference numeral 218. However, a different end wall is employed, so the end wall of FIGS. 8 and 9 has been given the reference numeral 224 rather than 24. Here again, the construction of the end wall 224 is not important to a practicing of our invention, although the folds incorporated therein are important for sealing purposes, just as the folds are in the end wall 24 of the earlier-described embodiment of FIGS. 1–6 (and also the slightly different embodiment of FIG. 7**).

In the present embodiment, a panel 234 is employed, this panel 234 constituting an individual patch having portions **234*a* and 234*b*. The portion 234*a* is secured to the end wall 224 by means of adhesive 236. Thus, the portion 234*b* functions as a flap in the same manner that the portion 234*b* functions (and also portion 134*b*). Hence, it will be understood that the portion 234*b*, being remote from the susceptor pad 30, remains unheated and is sufficiently cool so that it can be readily grasped by one's fingers without danger of being burned. It should be observed that the portion 234*b* extends upwardly from its hinged location labeled 238, so that heat is neither conducted nor radiated to any significant extent from the bag 218, thus functioning in virtually the same manner as does the flap portion 34*b* on the bag 18 and similarly to the portion 134*b* on the bag 118**.

We claim:

1. A package for use in a microwave oven comprising a flexible paper bag including a bottom wall, a top wall, pleated side walls between said bottom and top walls, and an end wall at one end of said bottom, top and side walls, the other ends of said bottom, top and side walls being closed, susceptor means for connecting microwave energy into heat overlying a portion of said bottom wall near said end wall and spaced from the other end of said bottom wall, and a flap extending from said end wall at a location spaced from said susceptor means, whereby said flap remains cooler than other portions of said bag so that said flap can be grasped in the handling of said bag after being heated in a microwave oven.

2. A package in accordance with claim 1 in which said flap is hingedly secured to said end wall at said location.

3. A package in accordance with claim 1 in which said flap extends upwardly and away from said end wall.

4. A package in accordance with claim 3 in which said flap extends above said top wall.

5. A package in accordance with claim 1 in which said flap extends downwardly and away from said end wall.

6. A package for use in a microwave oven comprising a flexible paper bag including a bottom wall, a top wall, pleated side walls between said bottom and top walls, and an end wall at one end of said bottom, top and side walls, the other ends of said bottom top and side walls being closed, for converting microwave energy into heat overlying a portion of said bottom wall near said end wall and spaced from the other end of said bottom wall, and a paper panel having a first portion secured to said end wall and an unsecured portion extending freely from said first portion.

7. A package in accordance with claim 6 in which said first portion is nearer said susceptor means and said second portion is farther from said susceptor means.

8. A package in accordance with claim 7 in which said second portion extends above said top wall.

9. A package in accordance with claim 8 in which said panel is an extension of said bottom wall.

10. A package in accordance with claim 6 in which said panel is an extension of said top wall.

11. A package in accordance with claim 6 in which said panel constitutes a separate patch.

* * * * *

UNITED STATES PATENT AND TRADEMARK OFFICE

CERTIFICATE OF CORRECTION

PATENT NO. : 4,864,090

DATED : September 5, 1989

INVENTOR(S) : Holly Maxwell and Warren D. Petersen

It is certified that error appears in the above-identified patent and that said Letters Patent is hereby corrected as shown below:

Col. 6, line 10; "connecting" should be -- converting --;
line 34; after "closed," insert -- susceptor means --.

Signed and Sealed this

Tenth Day of July, 1990

*Attest:*

HARRY F. MANBECK, JR.

*Attesting Officer*

*Commissioner of Patents and Trademarks*